US006287034B1

(12) United States Patent
Miraglia et al.

(10) Patent No.: US 6,287,034 B1
(45) Date of Patent: Sep. 11, 2001

(54) FLEXIBLE WALL COSMETIC CONTAINER

(75) Inventors: Loretta A. Miraglia, Monsey; Herve F. Bouix, New York, both of NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/685,258

(22) Filed: Oct. 10, 2000

Related U.S. Application Data

(62) Division of application No. 09/317,282, filed on May 24, 1999, now Pat. No. 6,158,912.

(51) Int. Cl.[7] ..... A46B 11/00

(52) U.S. Cl. ..... 401/122; 401/121; 401/126; 401/129

(58) Field of Search ..... 401/121, 122, 401/126, 128, 129, 130, 118, 119, 120, 152, 156

(56) References Cited

U.S. PATENT DOCUMENTS

| | | | | |
|---|---|---|---|---|
| 1,021,709 | | 3/1912 | Snow | 401/129 |
| 4,407,311 | * | 10/1983 | Gueret | 401/122 |
| 4,447,169 | | 5/1984 | Vartoughian | 401/269 |
| 4,503,872 | * | 3/1985 | Gueret | 401/122 |
| 4,780,017 | | 10/1988 | Bradford | 401/186 |
| 4,889,228 | * | 12/1989 | Gueret | 401/122 |
| 4,927,282 | | 5/1990 | Morane et al. | 401/129 |
| 4,929,108 | | 5/1990 | Gueret | 401/126 |
| 4,930,919 | | 6/1990 | Gueret | 401/126 |
| 4,952,204 | | 8/1990 | Korteweg | 604/1 |
| 4,982,838 | | 1/1991 | Fitjer | 206/209 |
| 4,991,989 | | 2/1991 | Fitjer | 401/155 |
| 5,054,946 | | 10/1991 | Morel | 401/122 |
| 5,141,347 | | 8/1992 | Fitjer | 401/126 |
| 5,599,125 | | 2/1997 | Vasas et al. . | |
| 5,688,572 | | 11/1997 | Slat et al. . | |
| 5,862,818 | | 1/1999 | Marinelli | 132/312 |

FOREIGN PATENT DOCUMENTS

| | | |
|---|---|---|
| 0 060 906 A1 | 9/1982 | (EP) . |
| 0 795 479 A1 | 9/1997 | (EP) . |
| 2 132 883 A | 7/1984 | (GB) . |
| 9117322 A | 5/1997 | (JP) . |

* cited by examiner

*Primary Examiner*—David J. Walczak
(74) *Attorney, Agent, or Firm*—Kenyon & Kenyon

(57) ABSTRACT

A container for pasty cosmetic product permits access to a larger percentage of the contained product. The hollow container has a wall that defines an internal chamber. At least a portion of the wall is flexible. A neck provides access to the internal chamber. An applicator projects into the container and is attached to a cap which closes the container about the neck. Otherwise inaccessible product is deposited on the applicator by squeezing the flexible portions of the container wall, thereby avoiding waste of product adhered to the innerternal surface of the container.

7 Claims, 4 Drawing Sheets

FLEXIBLE WALL COSMETIC CONTAINER

This application is a divisional of commonly assigned application Ser. No. 09/317,282, filed May 24, 1999, which issued as U.S. Pat. No. 6,158,912 on Dec. 12, 2000, and which is incorporated by reference herein, in its entirety.

FIELD OF THE INVENTION

The present invention relates to containers for cosmetic products in which the applicator projects directly into the container and contacts the product. More particularly, it relates to containers wherein at least a portion of the wall of the container is flexible so that, upon squeezing the container, the product is forced against the applicator, thus loading the applicator with product.

BACKGROUND OF THE INVENTION

Pasty cosmetics such as mascara, lip gloss, concealers, and eyeshadows are commonly sold in containers with an applicator projecting into the container and secured to the underside of the container cap. Radial or axial projections such as bristles, teeth, flocking, porous sponges, and the like, are provided on the applicator to hold cosmetic material thereon. The wall of the container is typically constructed of a rigid material which does not yield when pressure is applied.

To load a sufficient amount of product onto the applicator, most consumers repeatedly move the applicator axially within the container, similar to that of a pumping action. When the consumer feels she has loaded a sufficient amount of product, she removes the applicator from the container and then applies the product. With the repeated steps of insertion and removal of the applicator, the product within the container is depleted. During this depletion, the pasty nature of the product causes the product to adhere to the internal walls of the container and form a cavity defined by the product which remains adhered to the internal walls of the container. The product on the wall of the container is generally out of reach of the applicator when inserted into the container, and as a result, the consumer cannot remove all of the product from the container without significant difficulty. Thus, most of the product within such a container remains unused by the consumer.

Japanese Reference JP 9117322 proposes to solve this problem by incorporating a bag within the container. The bag is pushed by a pressure application board, which causes the applicator tip to be supplied with the cosmetic material. Various drawbacks are associated with this container. First, the incorporation of a bag within the container decreases the volume within the container and therefore decreases the amount of product which can be supplied to the consumer. Further, this proposed solution has many parts which are needed to make the package work, thus increasing manufacturing and assembly costs.

This invention provides for a cosmetic container which utilizes a flexible wall to allow the consumer to load a sufficient amount of product on the applicator without having to repeatedly "pump" the applicator within the container.

This invention also provides for a cosmetic container which allows a consumer to access a greater percentage of product within the container, thus allowing for less residual product to remain in the container.

Further, this invention also provides for a cosmetic container which is simple for a consumer to use.

Also, this invention provides for a cosmetic container that is a relatively simple device that avoids interference with the package aesthetics.

SUMMARY OF THE INVENTION

The present invention provides a container for a pasty cosmetic product which permits access by the consumer to a larger percentage of the contained product than has typically been possible in the traditional container. The present invention comprises a hollow container having a wall, wherein the wall defines an internal chamber and at least a portion of the wall is flexible. The container has a neck which provides access to the internal chamber. An applicator projects into the container and is attached to a cap which closes the container about the neck.

With the repeated steps of insertion and removal of the applicator, the product within the container is depleted. During this depletion, the nature of the product causes the product to adhere to the internal surface of the container and form a cavity where the applicator has removed the product. Upon the squeezing of the wall of the container of the present invention, the product adhered to the internal surface of the container is forced against the applicator, thus removing the product from the internal surface and enabling the use of a greater amount of product with little difficulty.

BRIEF DESCRIPTION OF THE DRAWINGS

Further objects and features of the present invention will be understood better in light of the embodiment examples which are discussed below with the aid of a drawing wherein.

DETAILED DESCRIPTION OF THE INVENTION

For purposes of clarity, the present invention will be described as used in conjunction with a mascara package. This example is merely illustrative, and in no way limits the present invention to mascara. It will be apparent to one of ordinary skill in the art how the present disclosure can be adapted for use with any pasty cosmetic product, pigmented or non-pigmented, including, but not limited to, lip gloss, eye shadow, lip balms, concealers, hair mascara, ointments, creams, gels, and the like.

Figure 1A:
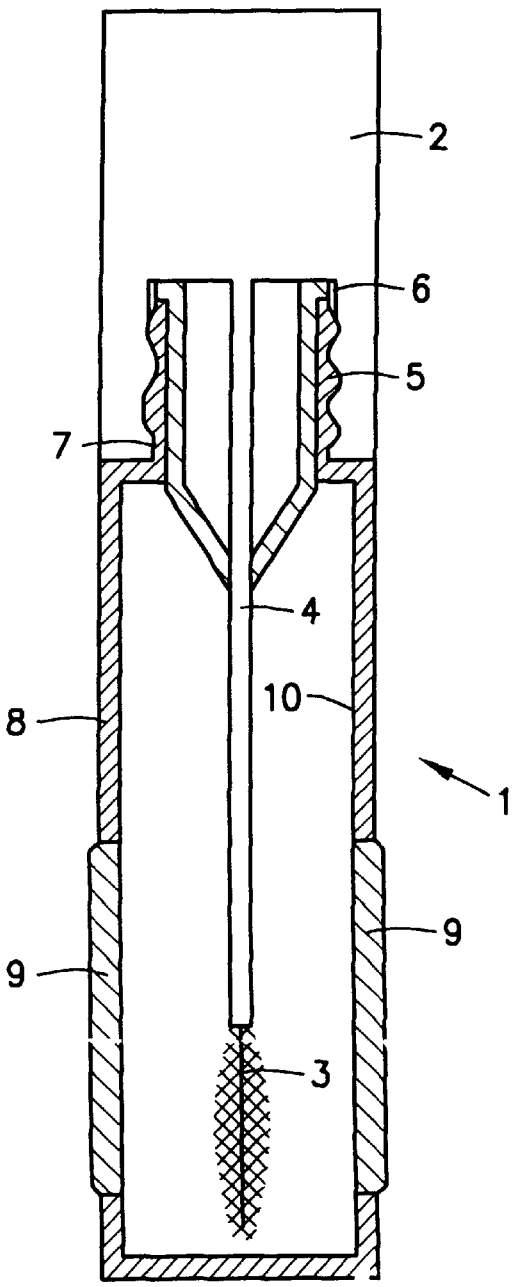
FIGS. 1A and 1B are cross-sectional views of a cosmetic package in accordance with the first embodiment of the present invention.
Figure 1B:
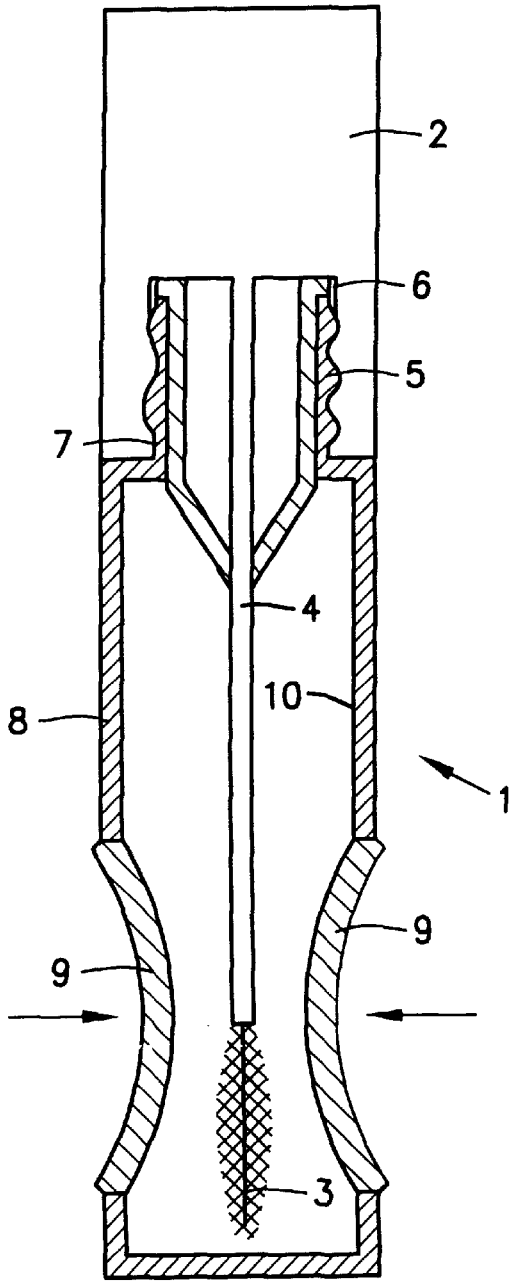

A mascara package, as seen in FIGS 1A and 1B, generally comprises a container 1 having a wall which defines an internal chamber, a cap 2 for closing the container, and an applicator 3, said applicator projecting into the container and attached to the underside of the cap 2 by a rod 4. The container 1 has a neck 5 which extends axially from one end of the container 1, said neck 5 providing access to the internal chamber of the container 1.

The neck 5 is provided with a means for attaching the cap 2 to the container. Preferably, as shown in the drawings, the means for attaching the cap 2 to the neck 5 of the container 1 consists of a set of opposing threads, one set positioned on the outer surface 6 of the neck 5, and the other set positioned on the inner surface 7 of the cap 2. Other means of attaching a cap to a container neck are known and can also be used with the same result, for example, a snap closure, or a lug style closure.

FIGS. 1A and 1B show one embodiment of the container of the present invention. The container 1 comprises a rigid frame 8 having at least one aperture. The aperture is then filled with a flexible member 9. The rigid frame 8 and flexible member 9 which comprise the container are separate components fused using bi-injection molding techniques. This process is carried out by either simultaneously or successively injecting different molten materials into separate sections of a mold until the separate components meet to fill the mold. Upon cooling the mold, the different materials fuse together where they intersect, thus providing a single article having different materials in specific sections.

The material comprising the rigid frame 8 can be polyethylene, such as low density polyethylene, high density polyethylene, or blends of varying density polyethylene; polypropylene; polyvinylchloride; polyesters; polyamides; nylons; or blends of other plastics, such as a polycarbonate/polypropylene mixture. Preferably, the rigid frame is composed of polypropylene.

The flexible member 9 is preferably an elastomeric or thermoplastic material, such as silicone, ethylene vinyl acetate copolymer (EVA), polyether amide block copolymer, polyester elastomer, ethylene propylene diene monomer rubber (EPDM), polyurethane, styrene butadiene styrene (SBS), styrene isoprene styrene, stytene ethylene-butylene styrene, styrene ethylene-propylene styrene, latex, and nitrile butadiene rubber.

With the embodiment shown in FIGS. 1A and 1B, the flexible member 9 is preferably placed adjacent to the location of the applicator when the applicator is within the container. The squeezing of the container at the flexible member will thus cause the product adhered to the internal surface 10 of the container to come into contact with the applicator 3, thereby loading the applicator 3 with product and increasing the amount of usable mass within the container 1. The ability of the container 1 to be squeezed in such a manner reduces the adverse effects typically associated with non-flexible pasty product containers, i.e., the container of the present invention provides access to the product adhered to the internal surface 10 of the wall of the container 1. The product is now capable of being easily placed in contact with the applicator 3 without the consumer having to repeatedly slide or "pump" the applicator within the container.

Figure 1C:
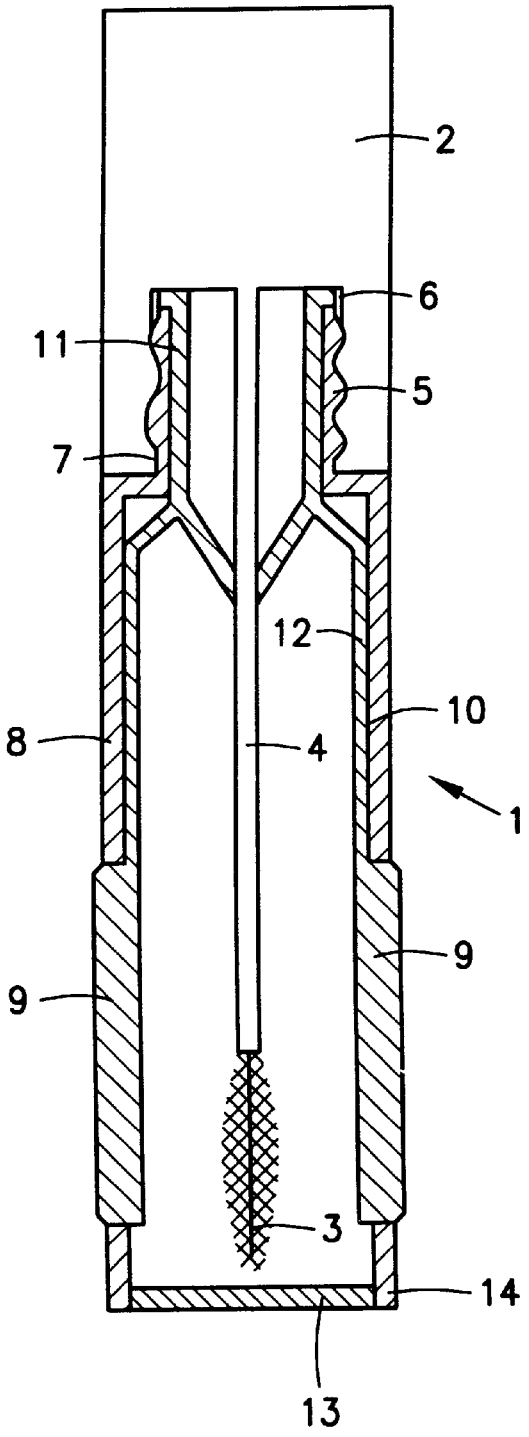
FIG. 1C is a cross-sectional view of a cosmetic package in accordance with an additional embodiment of the present invention.

In addition, and as shown in FIG. 1C, the wiper 11 within the neck 5 of the container can be bi-injection molded with the flexible member in a single process. With this single process, the wiper will be welded to the container in the same manner as the flexible member described above. This welding of the wiper will eliminate wiper retention problems associated with many mascara packages.

In many mascara packages the wiper is friction fit within the neck of the container. Over time, the repeated removal and insertion of the applicator causes the wiper to loosen and dislodge from the container neck so that, when the consumer removes the applicator from the container, she also removes the wiper. This, in turn, does not allow the applicator to be wiped and the consumer cannot apply mascara to the lashes.

With the embodiment of FIG. 1C, the wiper 11 is bi-injected along with the flexible member 9. Preferably, and as shown in FIG. 1C, the wiper 11 and flexible member 9 are made from the same material. When the wiper 11 and flexible member are the same material, preferably, the wiper and flexible member are connected by a web 12 which facilitates an easier molding operation requiring only a single injection point for the bi-injected material. The advantage to this embodiment is that, with one operation, a container with a neck finish, a secured wiper, and a flexible wall portion is yielded.

Because the wiper is already in place within the neck of the container this package needs to be bottom filled. Therefore, this package is delivered with the cap and applicator pre-assembled, and a plug 13 either in place or removed from the bottom 14 of the container. With the plug 13 removed from the bottom 14 of the container the container is then filled with the mascara. After filling the desired amount, the plug is secured to the underside of the container and the container is ready for sale. The plug 13 can be secured to the bottom of the container with either a screw fitting, a snap fitting, or the like, such means of securing a plug being known to one of ordinary skill in the art of cosmetic packaging.

Figure 2A:
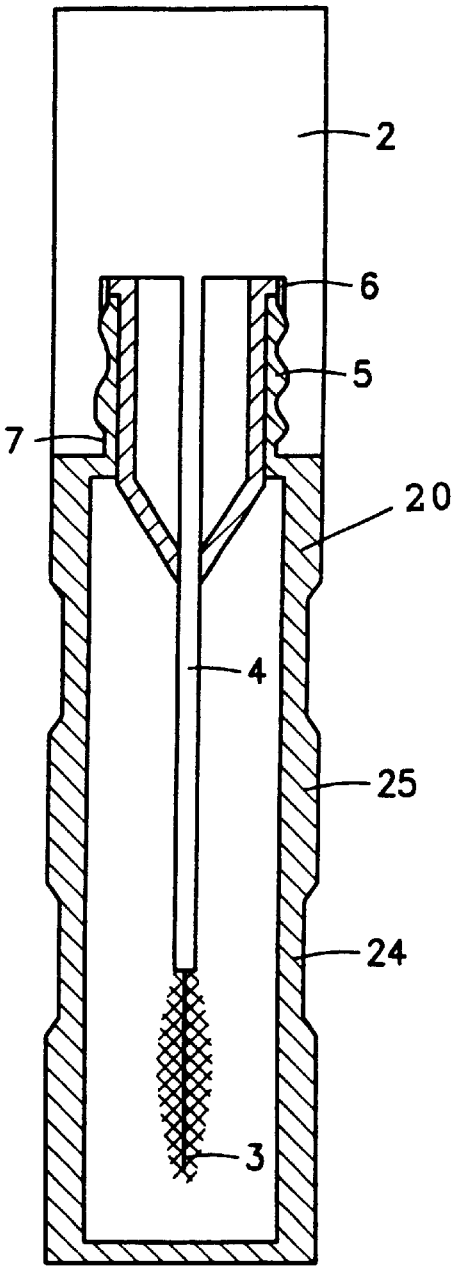
FIGS. 2A and 2B are cross-sectional views of a cosmetic package in accordance with a further embodiment of the present invention.
Figure 2B:
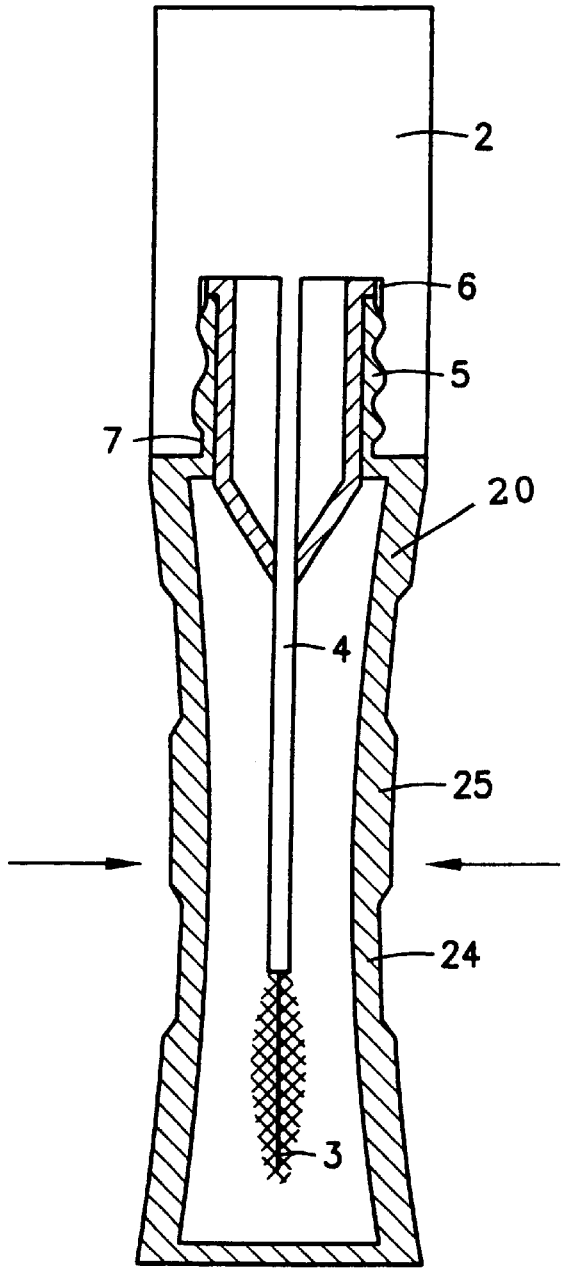

FIGS. 2A and 2B show a second embodiment of the container of the present invention wherein the container wall 20 is provided with at least one thin section 24 and one thick section 25, the thin section 24 being more flexible than the thick section 25. The thick section 25 gives support to the container structure while the thin section 24 flexes inward when pressure is applied by the consumer. The materials for the wall 20 can be polyethylene, such as low density polyethylene, high density polyethylene, or blends of varying density polyethylene, polypropylene, polyvinyl chloride, polyesters, polyamides, or nylons. Preferably, the wall 20 is composed of polypropylene or polyethylene. The ratio of the thickness of the thick section to the thickness of the thin section is preferably from about 2:1 to about 4:1, most preferably about 2:1. The thick section wall thickness is preferably from about 0.8 mm to about 1.1 mm, and the thin section wall thickness is preferably from about 0.4 mm to about 0.6 mm.

The function of the embodiment depicted in FIGS. 2A and 2B is the same as the embodiment of FIGS. 1A and 1B. The consumer simply squeezes the container body in the location adjacent to the applicator, and thus loads the applicator with product.

Figure 3A:
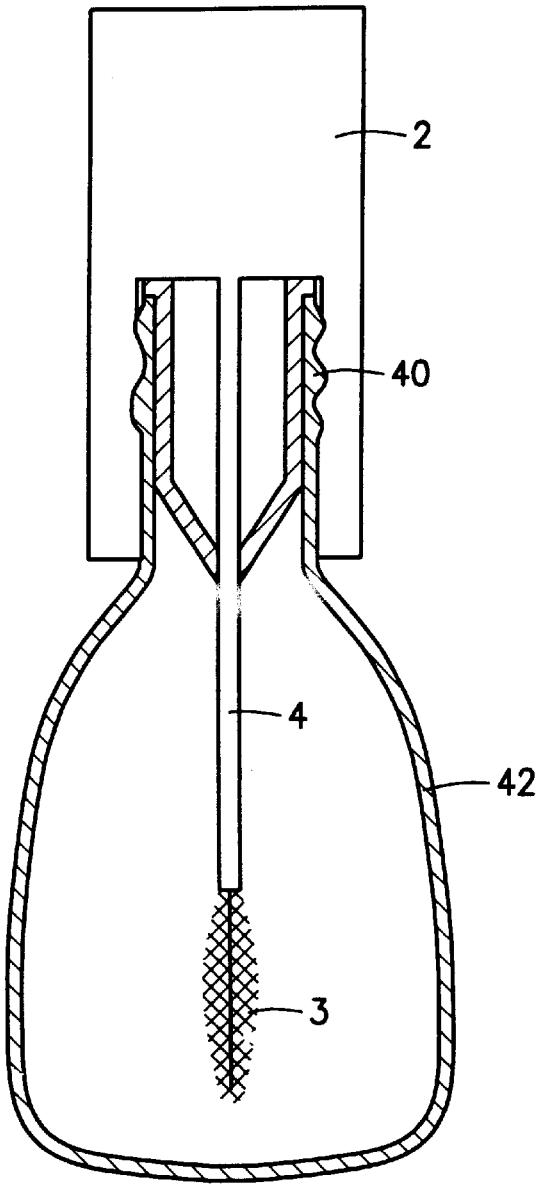
FIGS. 3A and 3B are cross-sectional views of a cosmetic package in accordance with another embodiment of the present invention.
Figure 3B:
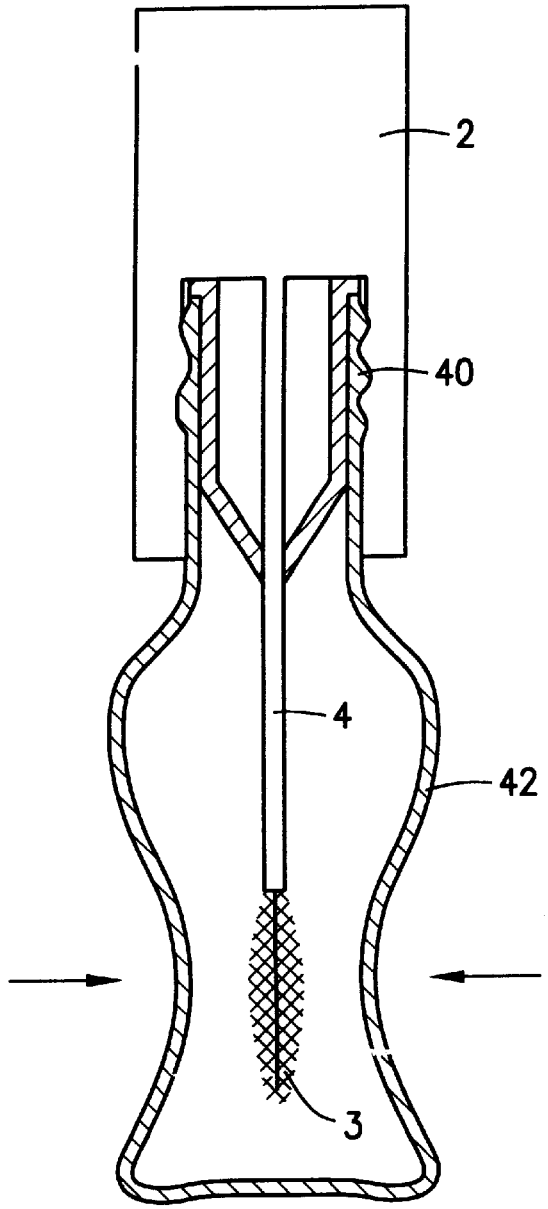

FIGS. 3A and 3B show a further embodiment of the container of the present invention. The container comprises a stiff neck section 40 and a flexible body section 42. The neck section 40 is composed of the same material as the body 42. The purpose of having a rigid neck section 40 is to ensure the fitting of the cap 2 on the container without deforming the container itself.

The neck 40 and the body 42 of the container are composed of an extruded multi-laminate material that is molded into the desired container shape. The body section 42 is sufficiently thick so that it will not collapse upon itself, and sufficiently thin so that a consumer can squeeze the body toward the applicator.

Extruded multi-laminates can be anywhere from two-ply to seven-ply, preferably three-ply to five-ply, where the layers of the multi-laminate are constructed of materials that together form a flexible body, for example, extrusions of polypropylene and ethylene vinyl alcohol; polypropylene and polyvinylidene chloride; and polypropylene and thermoplastic olefin elastomers.

The use of a flexible body section 42 allows the consumer to squeeze the container from any angle and along the entire length of the container, thus maximizing the use of the product within the container. Also, the ability to squeeze the container from any and all angles allows for the consumer to have an even distribution of product on the applicator 3, and eliminates the need for the consumer to slide the applicator axially within the container in order to load a sufficient amount of product on the applicator.

Depending on the product to be housed in the above-illustrated examples, additional treatments may be applied to the inside or the outside of the container. Such treatments include fluorination treatments, lamination of the container with a high barrier material, external coverings, and the like. For example, if a volatile mascara formulation were to be housed within the container, the internal surface of the container could be fluorinated to increase the container's barrier properties. Also, the external surface of the container can be provided with an overshell of a material, such as a thermoplastic olefin elastomer, in order to give the container a softer feel. The application of such treatments are well known to one of skill in the art.

The invention, and its broader aspects, is not limited to the specific details shown and described; rather, various modifications will be suggested to one skilled in the art, all of which are within the scope of this invention.

What is claimed is:

1. A cosmetic package for use with a pasty cosmetic product, the package comprising:

a hollow container having a wall defining an internal chamber, the wall having a first thickness and a second thickness thinner than the first thickness, the first thickness defining a first section in three portions forming a rigid support structure about the internal chamber, the second thickness defining a second section in two portions adapted to be selectively flexed inwardly in response to external pressure such that the internal chamber is constricted, wherein the three portions of the first section are separated by the two portions of the second section;

a neck attached to the container, said neck providing access to the internal chamber;

an applicator adapted to project into the internal chamber; and a cap, attached to the applicator, and adapted to close the container about the neck when the applicator is projected into the internal chamber.

2. The cosmetic package of claim 1 wherein the second section is positioned adjacent to the location of the applicator when the applicator is within the container.

3. The cosmetic package of claim 1 wherein the container is made from a material selected from the group consisting of polyethylene, polypropylene, polyvinyl chloride, polyesters, polyamide, and nylons.

4. The cosmetic package of claim 1 wherein the ratio of the first thickness to the second thickness is from 2:1 to 4:1.

5. The cosmetic package of claim 4 wherein the ratio of the first thickness to the second thickness is about 2:1.

6. The cosmetic package of claim 1 wherein the first thickness is approximately 0.8 to 1.1 mm and the second thickness is approximately 0.4 to 0.6 mm.

7. The cosmetic package of claim 1 wherein a wiper is placed within the neck of the container.

* * * * *